US005931744A

United States Patent [19]

Hackman

[11] Patent Number: 5,931,744

[45] Date of Patent: Aug. 3, 1999

[54] ADJUSTABLE STIFFNESS GOLF CLUB SHAFT

[76] Inventor: Lloyd E. Hackman, 15508 Fiddlesticks Blvd., SE, Ft. Myers, Fla. 33912

[21] Appl. No.: 09/038,228

[22] Filed: Mar. 11, 1998

[51] Int. Cl.[6] ..... A63B 53/10

[52] U.S. Cl. ..... 473/319; 473/323; 473/409

[58] Field of Search ..... 473/409, 289, 473/316, 317, 318, 319, 320, 321, 322, 323

[56] References Cited

U.S. PATENT DOCUMENTS

| | | | |
|---|---|---|---|
| 3,646,610 | 2/1972 | Jackson | 473/319 |
| 3,963,236 | 6/1976 | Mann | 473/289 |
| 4,000,896 | 1/1977 | Lauraitis | 473/319 |
| 4,122,593 | 10/1978 | Braly | 473/289 |
| 5,119,602 | 6/1992 | Shemesh | 451/507 |
| 5,814,268 | 9/1998 | Banchelin | 264/516 |

*Primary Examiner*—Steven Wong
*Assistant Examiner*—Stephen L. Blau
*Attorney, Agent, or Firm*—Frank H. Foster; Kremblas, Foster, Millard & Pollick

[57] ABSTRACT

A stepped golf club shaft with cylindrical segments joined by conical bands. The shaft is a composite with longitudinal and helical reinforcing fibers. The majority of the longitudinal fibers are located within the inner half of the shaft sidewall thickness, and the helical fibers are located within the outer half. A cutting tool is inserted into the bore of the hollow shaft and severs some of the longitudinal fibers to reduce the shaft stiffness, and therefore the natural frequency of oscillation, of the shaft.

9 Claims, 2 Drawing Sheets

ADJUSTABLE STIFFNESS GOLF CLUB SHAFT

BACKGROUND OF THE INVENTION

1. Field of the Invention

This invention relates generally to adjustments to the stiffness of a golf club shaft. More specifically, the invention relates to a method of adjusting the stiffness, and therefore the natural frequency, of a golf club shaft, and a golf club shaft having a natural frequency that is easily adjusted over a wide range of frequencies.

2. Description of the Related Art

It has recently been recognized that it is advantageous to match a golfer with his or her clubs. As a golfer swings a golf club, he or she applies forces to the handgrip which cause the club shaft to bend. The rate and degree to which each golfer applies forces to the club is unique, and therefore in order to optimize the power and accuracy of the golfer's swing it is desirable to give to that golfer a club having physical properties which are carefully matched to his or her unique swing characteristics.

Some characteristics of a golfer's swing can be quantified, as shown in U.S. Pat. No. 5,351,952, which is incorporated by reference. After quantifying these characteristics, the next step is to obtain a matching club, i.e., a club having physical properties matched to that golfer's unique swing characteristics. The shaft of the golf club is the part that has the most significant effect on a golf club's properties.

Golf club shafts are conventionally made of metal or a composite material, such as graphite fibers in an epoxy matrix. Composite shafts have longitudinal fibers to control longitudinal flexure or stiffness, and helical fibers for controlling torsional stiffness. The shape of most composite shafts gradually tapers along the length from handgrip to club head. The shape of most steel shafts either gradually tapers or tapers in steps, the latter of which is called a "stepped" shaft. A stepped shaft has multiple, distinct sections of different diameter, creating an overall appearance of tapering from a larger to a smaller diameter, but in small, abrupt steps. Stepped composite shafts have also been developed.

The number of potential combinations of golf swing characteristics is very high, resulting in an enormous number of different possible golf clubs. If it is desired that an inventory of finished golf clubs be kept on hand to suit any possible swing characteristics, the inventory would be unfeasibly large and costly. If, on the other hand, each golf club is custom manufactured from golf club parts which are taken from an inventory and can be modified within a spectrum of properties, the inventory necessary to be able to construct each club or set of clubs would still need to be very large. The characteristics of conventional golf club shafts can only be adjusted by a small amount, for example over a spectrum of 30 cycles per minute.

There is therefore a significant need for a method of tailoring the physical characteristics of a golf club to the swing of a golfer from a small inventory of golf clubs. There is also a need for a golf club which can be customized to a golfer's swing quickly and accurately. The natural frequency of such a golf club should be able to be varied over a large spectrum in order to keep the inventory at a minimum.

SUMMARY OF THE INVENTION

The invention is a method of reducing the natural frequency of oscillation of a golf club shaft having sidewalls with an interior surface defining a bore. The method comprises cutting into the interior surface of the sidewalls wherein "cutting" is defined to include slicing (in which no material is removed from the sidewalls), and abrading (in which material is removed from the inner surface of the sidewalls). The preferred form of cutting is abrading, which locally reduces the longitudinal stiffness of the sidewalls where the abrading occurs. With the preferred composite shaft, the abrading severs some of the longitudinal fibers, thereby reducing the longitudinal stiffness.

The invention also contemplates an elongated golf club shaft having sidewalls with an exterior surface and an interior surface defining a bore. The shaft comprises a matrix and a plurality of longitudinal fibers disposed within the matrix. A significant portion of the longitudinal fibers are preferably nearer the interior surface than the exterior surface.

Figure 1:
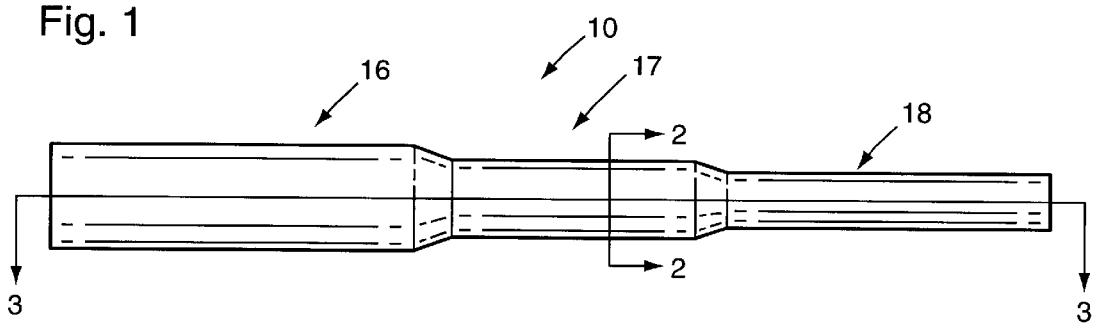
FIG. 1 is a side view illustrating the preferred golf club shaft.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF THE PREFERRED EMBODIMENT

Figure 2:
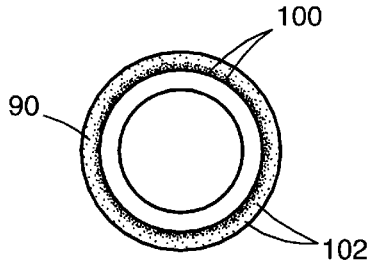
FIG. 2 is an end view in section taken through the line 2—2 of FIG. 1.
Figure 3:
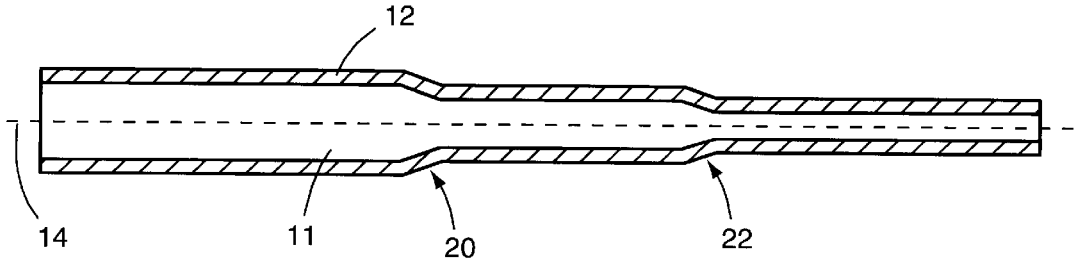
FIG. 3 is a side view in section illustrating the preferred golf club shaft.

The preferred golf club shaft 10 is shown in FIGS. 1, 2 and 3. The shaft 10 is elongated and hollow, having a sidewall 12 forming a chamber 11. The sidewall 12 is a composite material preferably consisting of graphite fibers in an epoxy matrix. The shaft 10 is divided along its length into preferably three cylindrical segments 16, 17 and 18, each of which has a diameter slightly different from an adjoining segment. The shaft 10 is 48 inches long, the top segment 16 is approximately 16 to 18 inches long, and the lower two segments 17 and 18 are equal in length at approximately 15 to 16 inches. Of course, shafts of different overall length and different segment length are contemplated.

Conical bands 20 and 22 connect each segment to an adjoining segment. The conical bands 20 and 22 need not be perfect mathematical cones, but are merely cone-shaped to bridge one end of a cylindrical segment of one diameter to the adjoining end of another cylindrical segment of a different diameter.

The internal diameter of the shaft 10 is highly controlled. Within the ends of each cylindrical segment, the distance between the axis 14 and the inner surface of the sidewall 12 (the segment's radius) does not vary significantly. Of course, the radius changes between the ends of each conical band 20 and 22.

The morphology of the sidewall 12 is typical of a conventional composite in many respects. There is a relatively flexible matrix material 90, such as an epoxy, in which a plurality of elongated, high strength graphite fibers 100 and 102 are embedded, as shown in FIG. 2. Most of the fibers are arranged longitudinally to provide significantly more strength and stiffness longitudinally than, for example, radially. This anisotropic configuration provides strength and stiffness to resist bending of the shaft 10, because when put to its ordinary use the shaft will be exposed primarily to bending forces. There are also some helically wound fibers to provide torsional strength and stiffness, because golf club shafts have a relatively small torsional force applied due to the golf club head (not shown) being offset from the shaft's axis 14.

The morphology of the sidewall 12 is atypical of composites, however, in one significant feature: the location of the fibers as shown in FIG. 2. Instead of dispersing the longitudinal fibers 100 equally throughout the thickness of the sidewall 12, a significant portion (between about 33% and about 90%) of the longitudinal fibers 100 in the present invention are located within the inner half of the sidewall thickness as shown in FIG. 2. A portion of the longitudinal fibers are located in the outer half of the sidewall thickness. This portion will be no less than about 10% and no more than about 67%. Furthermore, the helical fibers 102 are located primarily within the outer half of the sidewall thickness. Concentrating the longitudinal fibers 100 in the inner half of the sidewall allows the longitudinal stiffness of the shaft to be adjusted without affecting the torsional stiffness of the shaft. This stiffness adjustment will be described after a brief explanation of the general principles involved.

The natural frequency of a golf club shaft is the frequency at which the club shaft oscillates under certain conditions. These conditions simulate the conditions which exist when the club is swung by a golfer. The golf club shaft is held rigidly at the grip end in a clamp, and the opposite shaft end is displaced by bending the shaft from an at-rest, straight position. When the shaft end is released from the bent position it springs back toward the rest position and overshoots it, oscillating back and forth as a cantilevered beam. This oscillation occurs at a frequency which is a function of the stiffness of the shaft. The stiffness of the shaft is a measure of its resistance to bending deformation. A stiffer shaft will oscillate at a higher frequency than a less stiff shaft if all other factors are constant.

A golf club shaft having a stiffness which can be altered is advantageous to those who construct golf clubs to match a particular golfer's unique swing characteristics. This advantage arises from the ability to match a particular club to different golfers by merely adjusting the stiffness. A shaft having a stiffness which is easily and accurately adjusted over a wide spectrum is particularly advantageous, because fewer of such club shafts will need to be kept on hand to accommodate the wide spectrum of natural frequencies needed to match the many different golfers' swings. The stiffness of the preferred golf club shaft 10 can easily be adjusted, and the range of natural frequencies over which it can be adjusted is larger (60 to 80 cycles per minute or more) than standard shafts.

Figure 4:
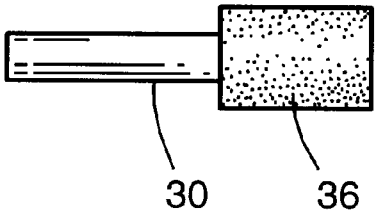
FIG. 4 is a side view illustrating a cutting tool.
Figure 5:
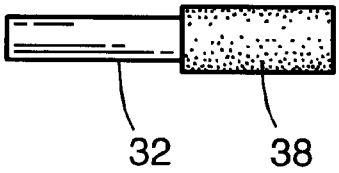
FIG. 5 is a side view illustrating a second cutting tool.
Figure 6:
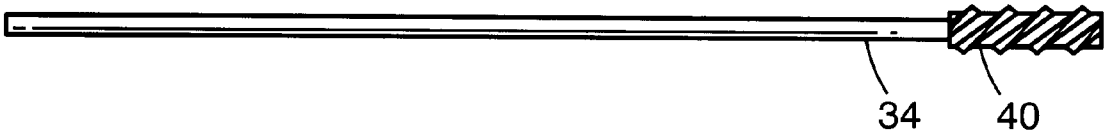
FIG. 6 is a side view illustrating a third cutting tool.

The preferred method of changing the stiffness of the shaft 10 involves inserting a tool, such as the tool 30 in FIG. 4, into the chamber 11 and cutting into the inner surface of the sidewall 12. By cutting it is meant that the tool slices into or more preferably abrades the sidewalls of the shaft. Slicing the sidewalls will cause severing of some of the reinforcing fibers within the sidewall 12, whereas the more preferred abrading of the sidewalls will remove part of the sidewall 12. Severing or removing the fibers reduces the longitudinal stiffness of the shaft, because some of the fibers which normally enhance the longitudinal strength of the composite shaft no longer do so in the local region where they are severed or removed. Severing or removing a predetermined number of fibers reduces the stiffness, and therefore the natural frequency, of the shaft by a predetermined amount.

The tools 30, 32 and 34 each have cutting surfaces 36, 38 and 40, respectively. The cutting surfaces can be of any type which can cut into and/or remove parts of the inner surface of the sidewall 12. For example, the cutting surfaces can be conventional sandpaper or a rough, hard surface, similar to the abrasive surfaces of a file or rasp. Alternatively, the cutting surfaces can be sharpened, knife-like surfaces, such as on a saw or rotating knife.

With an abrasive cutting surface, the fibers are severed by abrading away particles of the matrix and the fibers. However, with a different type of cutting tool, such as one which uses a knife-like cutting blade, the fibers may only be sliced through without removing any part of the matrix or fibers from the sidewall 12. Both forms of weakening the strength of the sidewall are considered "cutting", although it is abrading that is preferred.

The cutting surfaces preferably have a cylindrical outer surface with a diameter approximately equal to the diameter of the inner cylindrical surface of the sidewall 12 with which they are matched. In the preferred embodiment, for each segment of a shaft having a different inner diameter there is preferably a corresponding cutting tool having a matching outer diameter.

When it is necessary to cut into the sidewall to sever or remove some fibers in a particular segment of the shaft, the cutting surface of the corresponding tool is placed in contact with the inner surface of the shaft sidewall 12 and is moved rapidly relative to the inner surface, such as by rotation, longitudinal oscillation, rotary oscillation or a combination of these motions. The cutting action severs longitudinal fibers in the sidewall 12, thereby reducing the overall stiffness of the shaft 10.

As a material-removing cutting tool such as an abrasive (as distinguished from a severing-only cutting tool such as a knife) removes particles from the inner surface of the sidewall, the diameter of the inner surface of the sidewall increases as the sidewall thickness decreases. Therefore, it may be desirable to have a cutting surface which increases in outer diameter as the sidewall 12 is cut away, thereby removing material evenly from the entire circumferential inner surface of the sidewall 12.

The location or locations on the shaft 10 where the longitudinal fibers are severed affects both the overall stiffness of the shaft and the local flexure characteristics of the shaft. This can affect the "flex point" of the shaft 10. For example, if it is desired to reduce the overall stiffness of the shaft 10, the cutting tools 30, 32 and 34 are used to sever some of the longitudinal fibers at multiple points along the shaft's length. If, however, it is desired that the shaft 10 have a lower stiffness in one of the segments than the others, then the longitudinal fibers can be severed only, or primarily, in that particular segment. Furthermore, the fibers could be severed in only a particular region of a segment by cutting into the sidewall only in that particular region. In the preferred embodiment, some of the longitudinal fibers are severed near one or both of the ends.

Severing the longitudinal fibers in accordance with the present invention does not mar the shaft's exterior, which is the part of the shaft visible to a purchaser. This makes it possible to adjust the frequency even once the golf club is completely assembled. Additionally, because the helical, torsion-strengthening fibers are located near the outer surface of the shaft, they are not severed when the inner surface of the shaft is cut into or abraded. Therefore, the torsional stiffness is not significantly affected by reducing the longitudinal stiffness of the shaft.

The present method of reducing the stiffness of a shaft gives the best results with composite shafts of the type described. However, it is understood that the method will work with traditional golf club shaft materials, such as steel and other materials. When the inner sidewall of a steel golf club shaft is cut a predetermined amount such as by slicing or abrading, the stiffness is reduced less than the same amount of cutting on a shaft having the preferred composite structure. This is because in the preferred composite, the stiffness enhancing fibers are concentrated at the inner part of the shaft's sidewall, and therefore cutting of that part reduces the shaft's stiffness an amount which is disproportionate to (greater than) the depth of cutting. Steel shafts, on the contrary, are homogeneous, and therefore cutting any part of the shaft to reduce the sidewall thickness reduces the shaft's stiffness an amount proportionate to the amount of cutting, because the stiffness is essentially only a function of wall thickness.

Of course, more or fewer than the preferred number of cylindrical segments can be formed on a shaft. Selection of the number of segments may depend on the types of materials used, the skill level of the anticipated user and other factors. Alternatively, conical segments could be used instead of the preferred cylindrical segments and conical connecting bands 20 and 22. Of course, if each of the segments of the shaft is conically or otherwise differently shaped, the cutting surfaces of any cutting tools must have a matching conical, frusto-conical, or other matching outer surface.

With the preferred embodiment, the manner in which the shaft is designed to attach to a golf club head can affect the ease with which the stiffness of the shaft is reduced. Ordinarily, if the shaft is designed to be inserted into the hosel of the club head, it will have a small opening at the small end of the shaft into which a cutting tool can be inserted. If the shaft is designed with a larger insertion opening into the bore of the shaft at the narrow end to accept a hosel pin of a club head, the shaft has a somewhat larger passageway at the small end of the shaft. These passageways at the small end permit cutting tools to be inserted at both ends of the shaft, making cutting of the inner wall surface easier and more accurate. Because the smallest cutting tool for such a shaft can have length which is less than half the golf club shaft's length, it is less likely to vibrate and remove more on one side of the club shaft than another. Furthermore, the location of the cutting surface is more easily seen when the cutting tool extends into the small end than when it must be inserted in the large end to cut at the small end. Therefore, accuracy of cutting is enhanced with the design which allows a cutting tool to be inserted into the small end of the shaft.

While certain preferred embodiments of the present invention have been disclosed in detail, it is to be understood that various modifications may be adopted without departing from the spirit of the invention or scope of the following claims.

I claim:

1. A method of reducing the natural frequency of oscillation of a golf club shaft having sidewalls with an interior surface defining a bore, the method comprising cutting into the interior surface of the sidewalls without reducing a length of a shaft for locally weakening the longitudinal stiffness of the sidewalls where the sidewalls are cut.

2. A method in accordance with claim 1, further comprising removing a portion from the interior surface of the sidewalls.

3. A method in accordance with claim 2, wherein the step of removing comprises:

(a) inserting a tool having a cutting surface into the bore in contact with the interior surface of the shaft; and (b) rotating the tool.

4. A method in accordance with claim 2, wherein the step of removing comprises:

(a) inserting a tool having a cutting surface into the bore in contact with the interior surface of the shaft; and (b) oscillating the tool along a path having a circumferential component.

5. A method in accordance with claim 2, wherein the portion removed is located at a flex point.

6. A method in accordance with claim 2, wherein the step of removing comprises abrading the interior surface of the sidewalls.

7. A method in accordance with claim 6, wherein the step of abrading comprises:

(a) inserting a tool having an abrasive exterior surface into the bore in contact with the interior surface of the shaft; and (b) oscillating the tool along a longitudinal path.

8. A method in accordance with claim 6, wherein the step of abrading comprises:

(a) inserting a tool having an abrasive exterior surface into the bore in contact with the interior surface of the shaft; and (b) rotating the tool.

9. A method in accordance with claim 6, wherein the step of abrading comprises:

(a) inserting a tool having an abrasive exterior surface into the bore in contact with the interior surface of the shaft; and (b) displacing the tool's exterior surface along a path having a longitudinal and circumferential component.

* * * * *